US010004299B2

(12) United States Patent
Maussen

(10) Patent No.: US 10,004,299 B2
(45) Date of Patent: Jun. 26, 2018

(54) BUTTON FOR FASTENING FABRICS

(71) Applicant: MIGHTY STYLEY SL, Madrid (ES)

(72) Inventor: Joseph Franciscus August Alfred Maussen, Madrid (ES)

(73) Assignee: MIGHTY STYLEY SL, Madrid (ES)

( * ) Notice: Subject to any disclaimer, the term of this patent is extended or adjusted under 35 U.S.C. 154(b) by 0 days. days.

(21) Appl. No.: 14/891,511

(22) PCT Filed: Apr. 3, 2014

(86) PCT No.: PCT/EP2014/056733
§ 371 (c)(1),
(2) Date: Nov. 16, 2015

(87) PCT Pub. No.: WO2014/183922
PCT Pub. Date: Nov. 20, 2014

(65) Prior Publication Data

US 2016/0100655 A1 Apr. 14, 2016

(30) Foreign Application Priority Data

May 16, 2013 (EP) ..... 13168005

(51) Int. Cl.
*A44B 1/20* (2006.01)
*A44B 1/00* (2006.01)
(Continued)

(52) U.S. Cl.
CPC ..... *A44B 1/20* (2013.01); *A41F 1/02* (2013.01); *A44B 1/00* (2013.01); *A44B 1/08* (2013.01); *Y10T 24/36* (2015.01); *Y10T 24/3689* (2015.01)

(58) Field of Classification Search
CPC .... A44B 1/20; A44B 1/18; A44B 1/04; A44B 1/00; A44B 1/08; Y10T 24/36; Y10T 24/3609; Y10T 24/3689; Y10T 24/3916
See application file for complete search history.

(56) References Cited

U.S. PATENT DOCUMENTS 1,232,633 A 7/1917 Webber
1,407,406 A * 2/1922 Glazebrook ..... B66C 1/12 24/129 R
(Continued)

FOREIGN PATENT DOCUMENTS

CN 201294924 Y 8/2009
DE 37327 C 10/1886
(Continued)

OTHER PUBLICATIONS

Sep. 3, 2014—(WO) International Search Report and Written Opinion—App PCT/EP2014/056733.
Jul. 23, 2015—(WO) IPRP—App PCT/EP2014/056733.

*Primary Examiner* — Robert John Sandy
*Assistant Examiner* — Michael S Lee
(74) *Attorney, Agent, or Firm* — Banner & Witcoff, Ltd.

(57) ABSTRACT

Button for fastening fabrics, for instance clothing, wherein the button comprises a body and is provided with attachment means at a central location of the body, arranged for attaching, for instance by sewing, the button to a fabric, wherein the body of the button has a tapering width, seen in a direction parallel to the plane of the lower surface of the body, wherein the button is further provided with attachment means at or near the circumferential edge of the body and wherein the width of the body tapers towards the location of the attachment means at or near the edge.

16 Claims, 6 Drawing Sheets

(51) Int. Cl.
*A41F 1/02* (2006.01)
*A44B 1/08* (2006.01)

(56) References Cited

U.S. PATENT DOCUMENTS

| | | | | |
|---|---|---|---|---|
| 2,543,056 | A | 2/1951 | Pollack et al. | |
| 2,633,618 | A | 4/1953 | Moe | |
| 4,034,443 | A * | 7/1977 | Turner | F16G 11/14 24/129 B |
| 2006/0190041 | A1* | 8/2006 | Fallin | A61B 17/0401 606/232 |

FOREIGN PATENT DOCUMENTS

| | | | |
|---|---|---|---|
| FR | 423434 | A | 4/1911 |
| GB | 191223106 | A | 7/1913 |
| JP | 2002330802 | A | 11/2002 |
| JP | 2004173732 | A | 6/2004 |

* cited by examiner

BUTTON FOR FASTENING FABRICS

The application is a U.S. National Phase Entry of International Application No. PCT/EP2014/056733 filed on Apr. 3, 2014, designating the United States of America and claiming priority to European Patent Application No. 13168005.0 filed on May 16, 2013. The present application claims priority to and the benefit of the above-identified applications and the above-identified applications are incorporated by reference herein in their entirety.

The present invention relates to a button for fastening fabrics, for instance clothing, wherein the button comprises a body and is provided with attachment means arranged for attaching, for instance by sewing, the button to a fabric. The invention further relates to product at least partially manufactured from a fabric, for instance clothing, comprising at least one button.

Buttons for fastening sections of fabric as such are known and widely used in for instance clothing. Buttons typically have a planar body provided with attachment means, such as through holes for receiving threading, for connecting the button to the fabric. Although buttons are available having different shapes, most bodies of buttons are disc shaped.

JP2002330802A discloses a button according to the preamble with attachment means near a central location thereof and which has body with a tapering width ending in tip part at a distance from the central attachment means.

DE37327C relates to a button for forming a decorative string by interlocking a plurality of buttons at their peripheral edges. A button is hereto provided with an opening for receiving a ring of another button, wherein the ring is arranged for receiving a thread for forming the string.

U.S. Pat. No. 1,232,633A discloses a button arranged to link to margins of a garment, such as cut-away coats and dress coats, instead of being overlapped and buttoned by a button attached to one margin and fastened to a button hole on the opposite margin. The button is provided with a central shank so formed that it may be inserted through a buttonhole on a garment and will clamp against the material at the margin of the button, and having a flexible link attached near an edge to the button itself and adapted to be looped over a button on the opposite margin of the garment.

JP2004173732A discloses a button with a round or disc shaped body provided with a leg and a base part provided with attachment means.

U.S. Pat. No. 2,543,056A discloses a button having a round body having a bottom plane provided with central holes as attachment means and entrance openings closer to the circumferential edge of the body.

An interconnection between the fabrics is achieved by inserting the button into an accordingly shaped button hole. For loosening the sections of fabric, the button is again passed through the slit shaped button hole. In particular this unbuttoning action is however considered cumbersome, in particular when a plurality of buttons is used to fasten the sections of fabric.

It is therefore a goal of the present invention, amongst other goals, to provide an efficient, easy in use button which can be unbuttoned efficiently.

This goal, amongst other goals, is met by a button according to claim 1. More specifically, to meet this goal, amongst other goals, the button according to the preamble is characterized in that the button is provided with attachment means at or near the circumferential edge of the body. By attaching the button to the fabric at a location near the edge of the button such that these connection means are located on or near a slit shaped button hole on the other fabric section in fastened state, the button can be efficiently unbuttoned by pulling the two sections apart. The attachment means guide the button through the button hole on application of a pulling unbuttoning action.

The attachment means at or near the edge are preferably arranged to locally direct or bias the edge of the button towards the fabric for this guiding function. The attachment means are preferably arranged to guide one half, in particular the half of the button in the direction of the intended pulling action, through the button hole. The attachment means hereto preferable extend at a single half of the button.

Although it is possible to provided attachment means along a plurality of locations on the edge, it is preferred if the button is provided with attachment means at a single location at or near the circumferential edge. This results in an efficient design which is easy to unbutton.

The button is further provided with attachment means at a central location of the body. These central attachments for instance correspond to the connection means traditionally used in buttons and may include a plurality of through holes or a shank. According to this embodiment, the traditional attachment are located in or around the centre of the button, for instance in a regular pattern, while the attachment means near or at the edge extend a location radially outwardly at a distance from the centre, preferably at a single location.

To further guide the button through the button hole while unbuttoning, the body preferably has a tapered shape towards the attachment means near the edge arranged for guiding the button through the button hole. The tapering, i.e. decreasing width and/or height, is hereby preferably oriented in the longitudinal direction of the slit shaped button hole in the fastened position.

More specifically, the body of the button has a tapering width, seen in a direction parallel to the plane of the lower surface of the body, towards the location of the attachment means at or near the edge. In other words, the width of the body decreases towards the attachment means at or near the edge of the body. While traditional button are disc shaped, wherein the outer edge is circular, the button according to the invention has a tapered outer edge, wherein the tapered sections of the outer edge preferable extend substantially rectilinearly as mentioned below.

As the bottom of a button generally has a substantially flat surface, the width of the button is defined with respect to this surface. However, more generally, the body of the button has a height, width and length, wherein the height is substantially smaller than the width and the length. The length is defined along the line extending through the attachment means at or near the edge of the body and the centre of the body. The width extends perpendicular to the length.

To further improve the guidance, according to a further preferred embodiment, the body of the button has a tapering height, seen in a direction perpendicular to the plane of the lower surface of the body, towards the location of the attachment means at or near the edge. In other words, the height of the body gets smaller towards the attachment means near the edge.

The guidance is further improved if the body tapers along at least half of the length of the body, preferably more than half of the length, wherein the length is measured along the line extending through the attachment means at or near the edge of the body and the centre of the body. An even better guidance is achieved when the body tapers substantially rectilinearly or planarly.

The button can be efficiently attached to a fabric using a hole extending through the body. Therefore, according to a further preferred embodiment, the attachment means at or near the circumferential edge comprise at least one through hole extending between the upper surface and the lower surface of the body of the button. The through hole is arranged to receive threading.

It is possible that the body comprises two adjacently located through holes at or near the edge of the button. This allows easy sewing of the button.

It is however also possible that the body is provided with a single through hole at or near the circumferential edge. A loop of threading for attaching the button to the fabric then runs through the hole and along the outer edge of the button. This further enhances the unbuttoning efficiency as the button is directed more efficiently through the accordingly orientated button hole while unbuttoning with a pulling motion.

To reduce the visibility of the thread running along the outer edge of the button, the circumferential edge of the body near the through hole may comprise a recess extending between the upper and lower surfaces. The recess is hereby arranged to receiving the thread and is shaped accordingly, preferably such that the thread is countersunk in the recess.

According to a further preferred embodiment of a button according to the invention, the attachment means at or near the circumferential edge comprise a passage having two ends extending through the body, wherein the ends are located at the lower surface and/or the circumferential edge of the body. The upper surface hereby does not contain an end, such that the attachment means near the edge are not or hardly visible. The passage may hereto be suitably curved.

According to a further preferred embodiment, the body, seen in a cross sectional plane perpendicular to the line extending through the attachment means at or near the edge of the body and the centre of the body, has a tapering surface extending from one surface with decreasing height towards a lateral edge with the other surface. The tapering surface induces a rotational movement of the button upon unbuttoning, such that the button is guided through the slit. The tapering surface is preferably under an angle of substantially smaller than 90°, preferably smaller than 45° with respect to the other surface. Preferably, the tapering surface extends from the line, in particular the longitudinal axis, towards said edge and more preferably the tapering surface extends along at least half of the distance between the lateral edge and the line.

To further facilitate unbuttoning, it is preferred if the body has a first tapering surface extending from a first surface with decreasing height towards a lateral edge with the second surface and a second tapering surface extending from the second surface with decreasing height towards the opposed lateral edge with the first surface. The button hereby has two, oppositely orientated, tapering surfaces. The planes of the two surfaces, seen along a point in the cross-section, hereby preferably extend substantially parallel. In other words, the angle at which the surfaces extend with respect to the other surfaces are preferably substantially the same. Upon pulling on the button for unbuttoning, the two tapering surface induce a rotational movement, which makes it easier for the button to pass through the slit.

A smooth unbuttoning action is obtained if, seen in the cross sectional plane, the tapering surface makes an angle with the respect to the other surface, wherein the angle increases from a first lower value near the edge with the attachment means to a second larger value in a direction away from the edge with the attachment means. Near the location of the additional attachment means, i.e. at the tip of the tapering body, the angle is small, for instance 5-15°, preferably about 10° and increases in the direction along the lateral edge away from said point to an angle of for instance 40-50°, preferably about 45°. Upon movement of the button through the slit, the button then gradually rotated along an increasing angle, which allows an efficient unbuttoning action.

The button according to the invention can efficiently be unbuttoned by pulling in the unbuttoning direction, which is oriented in accordance with the tapering width of the body. However, to allow easy unbuttoning while pulling in two opposite directions, it is preferred if the button is further provided with second attachment means at or near the circumferential edge substantially opposite the first attachment means at the first edge of the body and wherein the width of the body also tapers towards the location of the second attachment means at or near the edge. The body hereby tapers into two directions, preferably seen along the line extending through the centre and the two attachment means at the edges. The button is hereby preferably mirror symmetrical with respect to a symmetry axis extending through said centre. It is even possible that such a button is not provided with additional attachment means, wherein the shape of the body itself already has a beneficiary effect on the ease of unbuttoning.

To induce a rotational movement upon pulling in both directions to facilitate unbuttoning as already described above, it is then preferred if both tapering ends, i.e. tapering in width, are provided with tapering surfaces for inducing the rotational movement. More specifically, it is preferred if the body comprises four lateral edges sections, wherein two first lateral edges sections extend towards the first attachment means at the first edge and wherein two second lateral edges sections extend towards the second attachment means at the first edge, wherein the body comprises tapering surfaces at two, preferably opposite, lateral edges sections of the body. The body hereby at least comprises tapering surfaces at a first lateral edge section and at a second lateral edge section opposite said first lateral edges section.

A further improved unbuttoning action is obtained if the two tapering surfaces are mirror symmetrical with respect to a plane extending through said line and perpendicular to the bottom surface. Each of the other first or second lateral edges may also be provided with tapering surface, the orientation of this surfaces being such that the planes of the tapering surfaces at the first lateral edge section are parallel and such that the planes of the tapering surfaces at the second lateral edge sections are parallel.

It is noted that the tapering surfaces may also be used in buttons not having the additional attachment near or at the edge, or in buttons not having a tapering width in the plane of the lower surface, i.e. for instance round buttons as commonly used. The problem is that these buttons are difficult to unbutton, in particular to guide the buttons through the slits accommodating said buttons.

Therefore, the invention furthermore relates to a button for fastening fabrics, for instance clothing, wherein the button comprises a body and is provided with attachment means at a central location of the body, arranged for attaching, for instance by sewing, the button to a fabric, wherein, seen in a cross sectional plane perpendicular to a line extending through the attachment means in plane parallel to the plane of the lower surface of the body, the body has a tapering surface extending from one surface with decreasing height towards a lateral edge with the other surface, and wherein the tapering surface extends along at least half of the distance between the lateral edge and the line. The tapering surface induces a rotational movement of the body, which facilitates unbuttoning as described above. The button may hereby be round or for instance be provided with a body having a tapering width, wherein the body tapers in the direction of said line extending through the centre. It is again preferred if the body has a first tapering surface extending from a first surface with decreasing height towards a lateral edge with the second surface and a second tapering surface extending from the second surface with decreasing height towards the opposed lateral edge with the first surface, for the reasons set out above. It is further again, for the reasons set out above, preferred if, seen in the cross sectional plane, the tapering surface makes an angle with the respect to the other surface, wherein the angle increases from a first lower value near the edge with the attachment means to a second larger value in a direction away from the edge with the attachment means.

Another solution based on the idea to facilitate unbuttoning by making it easier to pass a button through a corresponding slit upon a pulling force, to provide an easy in use button which can be unbuttoned efficiently, is to, according to another aspect of the invention, to provide a button for fastening fabrics, for instance clothing, wherein the button comprises a body and is provided with attachment means, arranged for attaching, for instance by sewing, the button to a fabric, wherein the body of the button has a tapering width, wherein the width decreases along a tapering direction seen in a direction parallel to the plane of the lower surface of the body, wherein the attachments means are moveable from a central location towards an edge of the body along said line. As the attachment means are moveable towards the edge, the button can be unbuttoned easily, as the button is then efficiently urged through the slit. The attachment means are preferably moveable due to an applied unbuttoning pulling force. Upon pulling, the attachment shift towards the edge, thereby forcing said edge towards the slit and guiding the button through said slit upon a further pulling action.

The attachment means, for instance in the form of a ring shaped member, are preferably moveable on, or in a plane parallel to, the lower surface of the body of the button. The lower surface may for instance be provided with guiding means, for instance a groove, for receiving and guiding the attachment means.

It is preferred if the attachment means comprise biasing means for biasing the attachment means towards the central location. In an unloaded state, the attachment means hereby extend at the central location to prevent accidental unbuttoning, whereby upon a pulling force, the attachment means shift towards the edge. Upon releasing the pulling force, the attachment means shift back to the centre. The attachment means preferably comprise resilient means, for instance in the form of a spring for biasing the attachment means towards the centre. The attachment means, for instance in the form of a ring for receiving threading, are for instance connected with the body via the biasing means, in particular in the form of the spring. The attachment may furthermore be in the form of a hole arranged in the spring for receiving threading. It is further possible that the biasing means, preferably in the form of a spring, are arranged in the guiding means in the form of a groove.

The invention further relates to a product, in particular clothing, at least partly manufactured from a fabric, wherein the fabric is provided with at least one button according to the invention.

A further preferred embodiment of the product in accordance with the invention further comprises a slit extending in a longitudinal direction and arranged for receiving the button, wherein the button and the corresponding slit are oriented such that the attachment means at or near the circumferential edge of the body of the button is on the longitudinal direction of the slit. As said, this enhances the efficient unbuttoning action.

To further direct the button in the direction of the button hole upon unbuttoning, according to a further preferred embodiment, the distance between the button and the fabric at the location of the attachment means at or near the edge is smaller than this distance at a central location of the button.

To provide a passage for the button upon unbuttoning through a slit provided in the product, it is preferred, according to a further preferred embodiment, if the slit is provided with widening means for widening a portion of the slit, for instance the end portion thereof, for easy unbuttoning of a button. The widening means are preferably provided at these location where the button is to pass through the slit upon unbuttoning. It is preferred if the widening means comprise at least one slit. This slit, preferably the plurality of slits, is/are preferably narrower than the main slit. The length of the slits of the widening means preferably have a length in the range of 5-30%, more preferably 5-15%, of the length of the main slit. Although the slits may be provided in line with the main slit, it is preferred if the slits as widening means extend under angle with respect to the longitudinal axis of the slit. This allows the body, in view of the width thereof, to pass through the slits.

To prevent accidental unbuttoning, it is preferred if product comprises resilient means associated with said widening means for biasing the widening means in their closed position. The widening means are arranged to widen the slit to allow passage of the button upon unbuttoning. By providing resilient means associated with said widening means, for instance in the form of slits as described above, the slits are kept closed, until a pulling force against said biasing force of the resilient means is exerted, thereby opening said slits to widen the main slit. The resilient means may for instance comprise elastic fabric provided to surround said widening means, for instance in the form of slits.

It is to be noted that a product provided with a slit for a button provided with the widening means can also be used with conventional buttons. The invention therefore also relates to a product, in particular clothing, at least partly manufactured from a fabric, wherein the fabric is provided with at least one button and at least one slit for receiving said button, wherein the slit is provided with widening means for widening a portion, for instance an end portion, of the slit for easy unbuttoning of a button.

The present invention is further illustrated by the following Figures, which show a preferred embodiment of the button according to the invention, and are not intended to limit the scope of the invention in any way, wherein.

Figure 1:
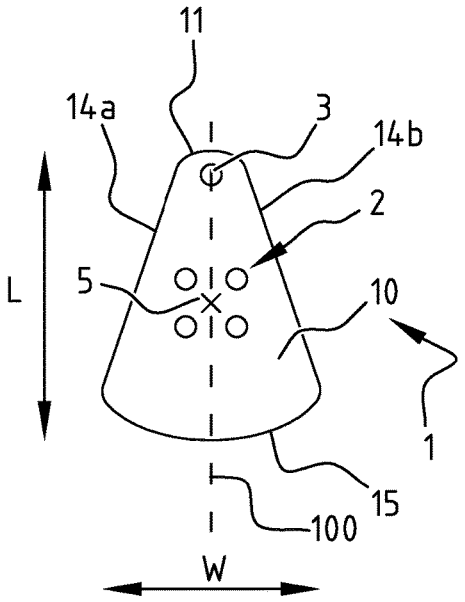
FIG. 1 shows a first embodiment of the button in top view.
Figure 6:
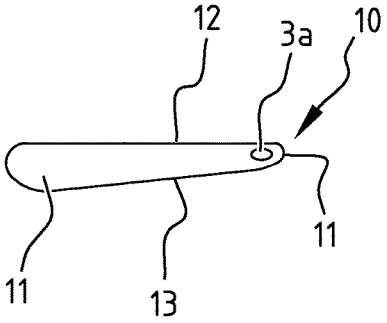
Figure 7:
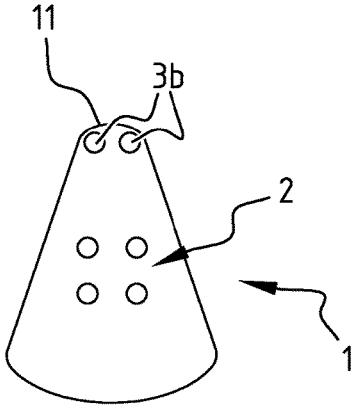
Figure 8:
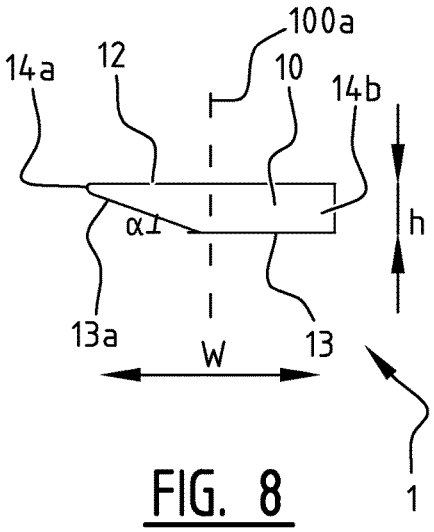
Figure 9:
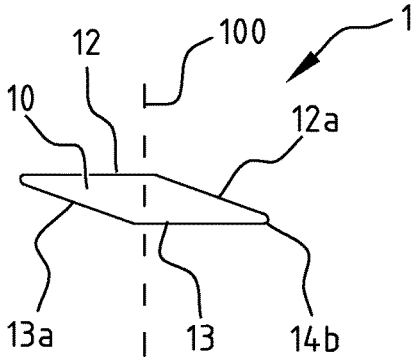
Figure 10:
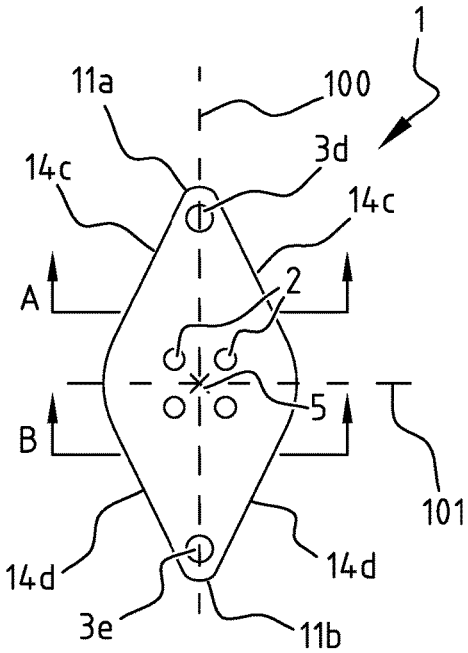
Figure 11:
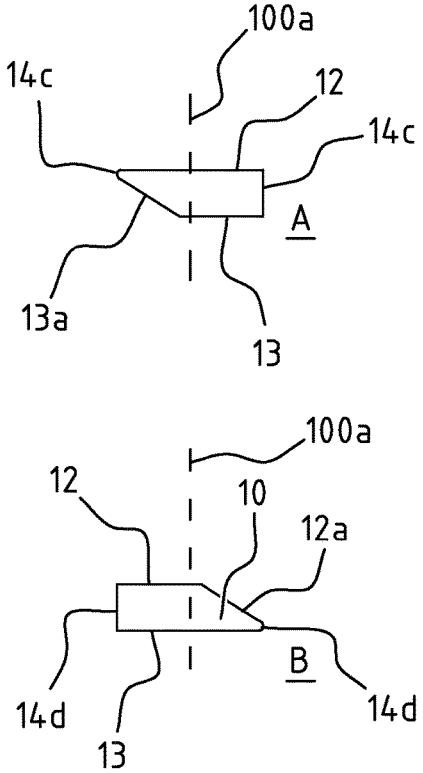
Figure 12:
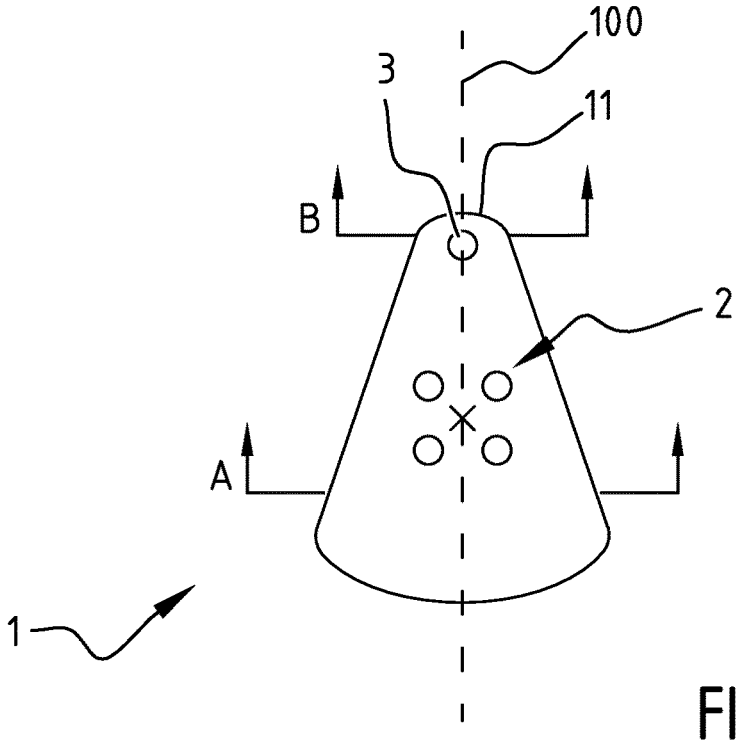
Figure 14:
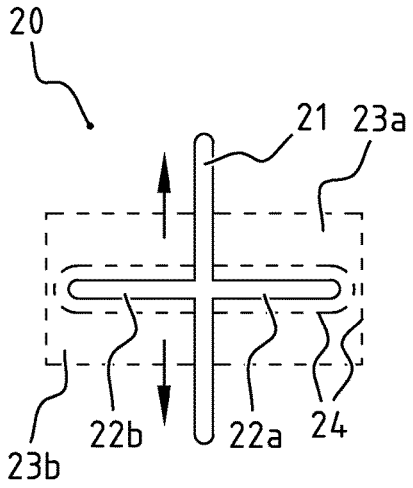
Figure 15:
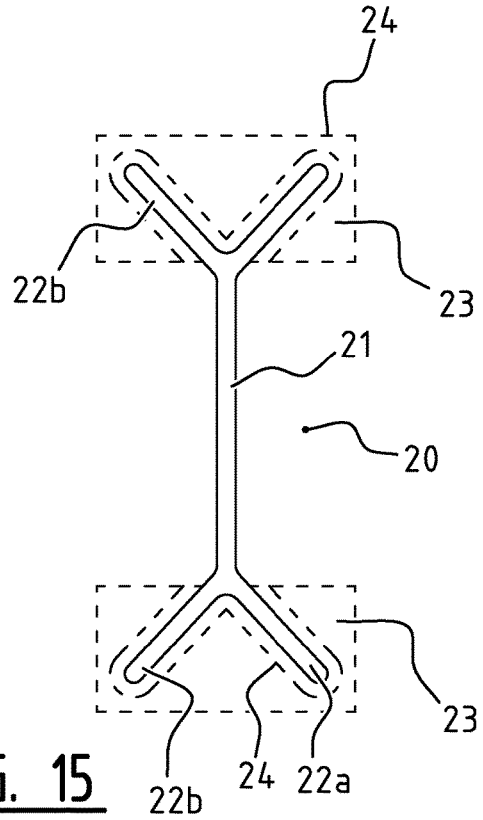
Figure 16:
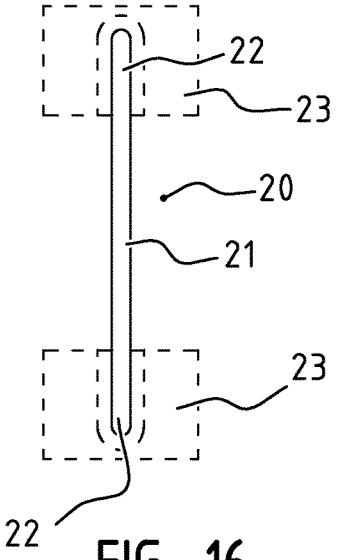
Figure 17:
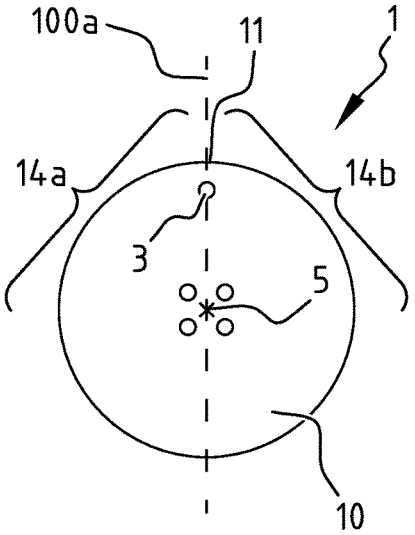
Figure 18:
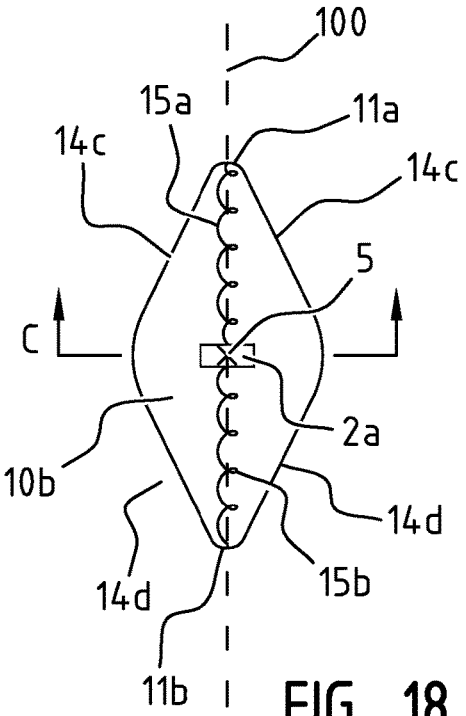
Figure 19:
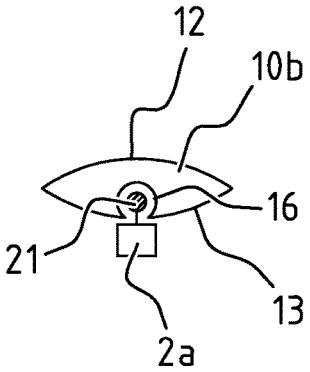

FIGS. 3-5*b* show further embodiments in top view;

FIG. 6 shows a further embodiment in side view;

FIG. 7 shows a further embodiment of the button in bottom view;

FIGS. 8 and 9 show cross sections of the button;

FIG. 10 shows a further embodiment of the button in top view;

FIGS. 11*a* and *b* show cross sections of the button as shown in FIG. 10 along lines A and B;

FIG. 12 corresponds to the button of FIG. 1;

FIGS. 13A and B show cross sections of the button of FIG. 12 along lines A, respectively line B;

FIGS. 14-16 schematically show products provided with different embodiments of slits;

FIG. 17 shows another embodiment of the button according to the invention;

FIG. 18 shows another embodiment of the button in bottom view;

FIG. 19 show a cross section of the button of FIG. 18 along line C; and

Figure 20:
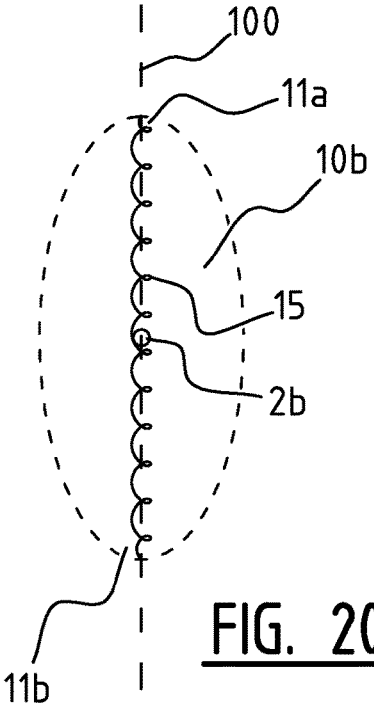

FIG. 20 schematically shows an another embodiment of the button in bottom view.

A button 1 according to the invention is shown in FIG. 1 which is formed by a body 10. At the centre 5, the body 10 is provided with four traditional holes 2 for sewing the button 1 to a fabric. Provided near an edge 11 of the button is provided an extra hole 3 which extends through the body 10 from an upper surface 12 to a lower surface 13, see FIG. 2. The region with the through hole 3 is indicated with 6 in FIG. 2.

Figure 2:
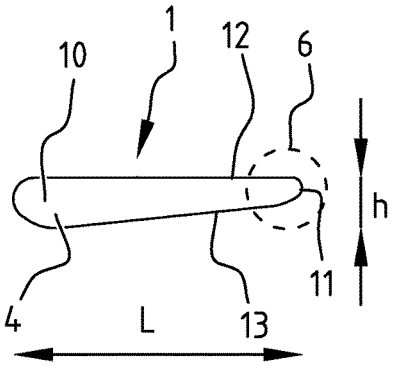
FIG. 2 shows the button of FIG. 1 in side view.

FIG. 2 further shows that the body 10 is tapered towards the edge 11 provided with the extra hole 3. The height h of the body 10 at the location of the hole 3 is smaller than at a location at the opposite side, indicated with 4. The body 10 is tapered along more than half of the length 1 of the body 11.

This length 1 is measured along the line 100, see FIG. 1, extending through the extra hole 3 and the centre 5 of the button 1. Also the width w of the body 10 is tapered. The body 10 is provided with two linear sections 14*a* and 14*b* which also extend along at least the half of the length 1 of the button 1. The outer edge 11 is hereby formed by an arc shaped section 15, two linear sections 14*a*, 14*b* and again an arc shaped section near the extra hole 3, near the reference numeral 11 in FIG. 11. This shape of the body 11 allows an enhanced guidance through a button hole which facilitates unbuttoning.

Figure 3:
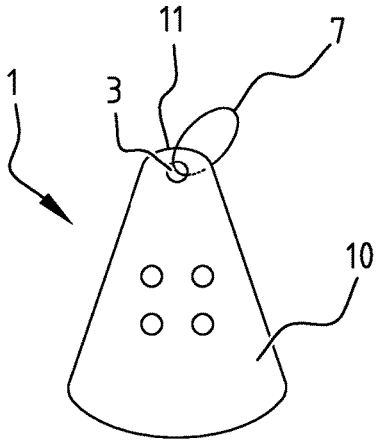
Figure 4:
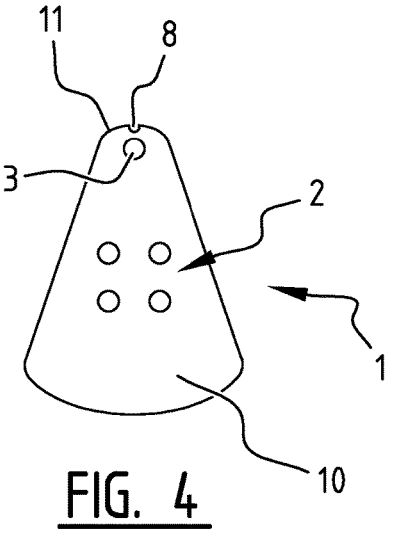

In FIG. 3 the button 1 is shown with a thread 7 for attaching the extra hole 3 to the fabric. It goes without saying that also the holes 2 are provided with suitable threading. As the button 1 is only provided with a single hole 3 at the edge region, the loop of the thread 7 extends along the outer edge 11. The edge 11 of the embodiment as shown in FIG. 4 is provided with a recess 8 to receive the thread such that the thread is countersunk in the edge 11.

Figure 5A:
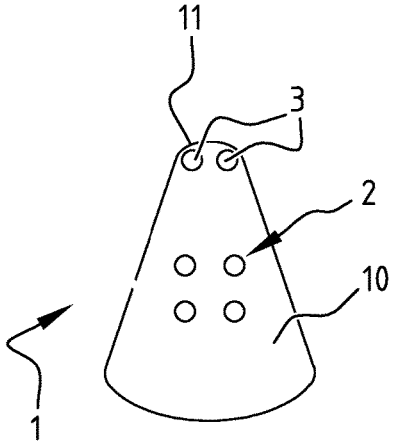
Figure 5B:
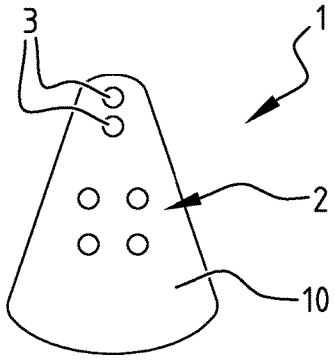

As an alternative as shown in FIGS. 5*a* and 5*b*, the body 10 can be provided with two extra holes 3 for securing the button 1 to the fabric. In FIG. 5*a* the holes 3 extend adjacently in the width direction of the body 10, whereas the holes 3 in the embodiment of FIG. 5*b* extend adjacently along the length of the body 10.

To hide the extra connection of the button 1 according to the invention, the edge 11 self can be provided with a curved passage 3*a*, see FIG. 6. The passage 3*a* extends between the surface forming the edge 11, such that threading extending through this passage 3*a* is difficult to see from the top side 12.

As an alternative as shown in FIG. 7, a passage 3*b* extends between the lower surface 13, wherein both ends of the passage 3*b* are located on the lower surface 13. The passage 3*b* is hereto also suitably curved.

In FIG. 8, the button 1 is shown in cross section, the cross section taken in a plane perpendicular to the line 100 in FIG. 1, which is shown as a plane 100*a* in FIG. 8. As can be seen, the bottom surface 13 is provided with a tapering surface 13*a* which tapers, i.e. has a decreasing height h towards lateral edge 14*a*. The tapering surface 13*a* hereby forms an edge surface, wherein this surface is under an angle $\alpha$ of approximately 45° with the lower surface 13. The top surface 12 hereby extends substantially planar. The tapering surface 13*a* tapers from the plane of the lower surface 13 substantially towards the plane of the upper surface 12. In this example, the tapering surface 13*a* extends from a location near to the line 100 towards said lateral edge 14*a*. However, in case of buttons having a smaller height, the surface may not extend until the line 100, if the surface is to extend at an angle of approximately 45°. The surface 13*a* induces a rotational movement upon unbuttoning, which makes unbuttoning more easily.

The other lateral edge 14*b* as shown in FIG. 8 is normal edge 14*b* and may be somewhat rounded as is custom in the art. However, to further improve the rotational movement, it is preferred if also the other lateral edge 14*b* is provided with a tapering surface 12*a*, which tapering is opposite the tapering of the first tapering surface 13*a*. Indeed, as can be seen in FIG. 9, the top surface 12 is also provided with a tapering surface 12*a* which extends from the upper surface 12 downwardly towards the edge 14*b* in the plane of the lower surface 13. The surface 12*a* again covers almost half of the upper surface 12, seen in cross section.

The button 1 as shown in FIG. 10 can be easily unbuttoned by pulling in any direction along line 100. The body is thereto provided with two tapered ends, i.e. towards edge 11*a* with additional attachment means 3*d* and towards edge 11*b* with additional attachment means 3*e*. At least in top view, the button is mirror symmetrical along plane 101, also extending through centre 101. The button 1 comprises four lateral, tapering edges 14*c, d* which form the outer edges of the button 1. As is shown in FIG. 11*a*, which shows a cross section along line A in FIG. 10, the left lateral edge 14*c* is provided with a tapering surface 13*a* similar to the surface as shown in FIG. 8. The surface 13*a* extends from the plane of the top surface 12 towards the plane of the lower surface 13. It is noted that the right lateral edge 14*c* as shown in FIG. 9*a* may also be provided with a tapering surface as is indicated with 12*a* in FIG. 9, such that the cross section along line A in FIG. 10 corresponds to the cross section as shown in FIG. 9.

The right lateral edge 14*d* on the lower side of the button, lower as seen in FIG. 10, i.e. opposite the plane 101, is at least provided with a tapering surface 12*a* at the top surface 12. Optionally, also the left edge 14*d* may be provided with a surface 13*a*.

Figure 13:
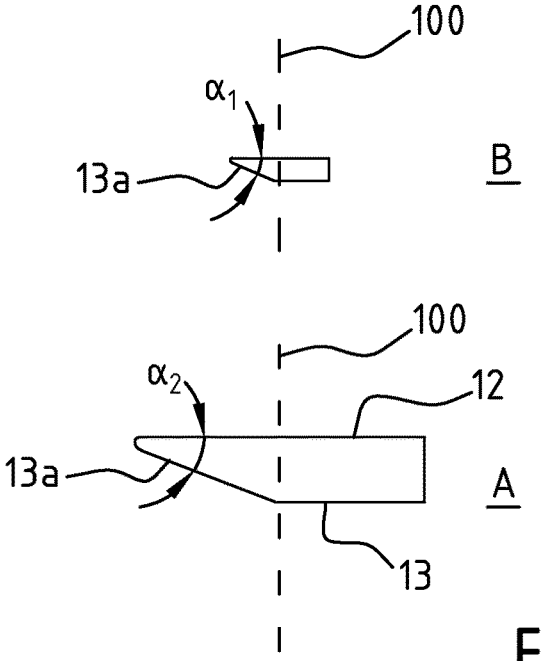

The shape of a tapering surface 13*a* will further be elucidated with reference to FIGS. 12 and 13, wherein the button 1 as shown in FIG. 12 corresponds to the button 1 as shown in FIG. 1. FIG. 13A shows a cross section perpendicular to line 100 along line A in figure A, i.e. at a location away from the edge or point with the additional attachment means 3. The surface 13*a* at that location is under an angle $\alpha_2$ of 45° which is larger than the angle $\alpha_1$ that the surface 13*a* makes at the location B near the edge 11. The angle at which the surface 13*a* extends with respect to the upper surface 12 therefore decreases towards the edge 11. This induces a smooth rotational movement of the button upon unbuttoning, which facilitates unbuttoning. A tapering surface 12*a* provided at the top surface 12 may have a similar configuration.

It is noted that the tapering surfaces as such as shown in FIGS. 8, 9 and 13 can be also be used in buttons having other circumferential shapes, such as a round button as shown in FIG. 17. A first lateral edge section 14*a* may for instance be provided with a first tapering surface 13*a* similar to the surface 13*a* as shown in FIG. 9, while a second lateral edge section 14*b* opposite a plane 100*a* extending through the centre 5 may be provided with the surface 12*a* as shown in FIG. 9. The button may, or may not be, provided with attachment means 3 at the edge 11.

With reference to FIGS. 14-16 a product 20, in particular a piece of clothing, provided with a slit 21 for receiving a button. The slit is specifically suitable to cooperate with any of the buttons as shown in any of the earlier figures, or FIGS. 18 and 19 as will be discussed later, but can also be used with a traditional shaped button.

To allow easy passage of a button upon unbuttoning, the slit 21 is provided with extra slits 22*a* and 22*b* which open up when a pulling force is exerted on the product and/or the button accommodated in the slit 21. The slits 22*a*, 22*b* extend at both sides of the slit 21 and perpendicularly with respect to the longitudinal axis of the slit 21.

The slits 22*a*, 22*b* then open up in a direction indicated with the arrows in FIG. 14 which increases the area for passage of a button. To prevent accidental unbuttoning, elastic sheets 23*a* and 23*b* are arranged behind the slits 22*a* and 22*b* on both sides of the slit 21. The elastic sheets 23*a* and 23*b* are sowed with sowing lines 24 along the outer perimeter and along the perimeters of the slits 22*a,b*. The elastic sheets 23*a,b* bias the slits 22*a* and 22*b* in their closed position, i.e. in a direction against the arrows shown in FIG. 14. The sowing lines 24 should preferably not cross the slits at any point.

The product 20 of FIG. 15 is different with respect to the product in FIG. 14 in that both ends of the slit 21 are provided with widening means, each of the widening means in the form of two smaller slits 22*a* and 22*b* extending under an angle with respect to the longitudinal axis of the slit 21. Each of the slits 22*a*, 22*b* is again backed by an elastic sheet 23 sowed 24 to the product 20 to prevent accidental unbuttoning. In particular this embodiment is also suitable to be used without elastic sheets 23. The length of the slits 22*a*, 22*b* is then preferably in the range of 5-15% of the length of the main slit 21.

The extra slits 22*a, b* do not necessarily extend under an angle with respect to the longitudinal axis of the slit. As shown in FIG. 16, the extra slits 22 as provided at the ends of the main slit 21 extend in the same direction as the main slit 21, i.e. dependent on the orientation of main slit which may for instance be horizontal or vertical. Elastic sheets 23 are again provided.

An alternative for the attachment means 3 provided in addition to the central attachment means at the centre 5 of a button to allow easy unbuttoning, it is possible to provide attachment means 21 which are moveable with respect to the body 10*b* of a button 1*b*, see FIGS. 18 and 19, wherein FIG. 19 shows the button 1*b* as shown in bottom view in cross sectional view along line C.

The attachment means are ring shaped, see in particular FIG. 19, and are provided with a protrusion 21 which is received and arranged to slide in a groove 16 provided in the lower surface 13 of the button 10*b* along the longitudinal direction 100 of the button 1*b*.

The attachment means 2*a* are connected with springs 15*a* and 15*b* near ends 11*a, b* on opposite ends on the longitudinal axis 100. Springs 15*a, b* bias the attachment means towards the centre 5. It is also possible to use a single spring, wherein the attachment means are connected to a central section thereof. The body 10*b* of the button 1*b* is further tapered twice, similar to the embodiment of FIG. 10.

Upon exerting an unbuttoning force, the attachment means 2*a* will move in a direction indication with A or B, dependent on the direction of the pulling force, thereby moving the attachment means to a location at or near the edge 11*a, b* of the body 10*b* of the button 1*b*. In this position, the button 1*b* is easily guided to a slit for easy unbuttoning. Upon releasing the button 1*b*, the springs 15*a, b* will force the attachment means 2*a* towards the initial, i.e. central location.

In FIG. 20, an alternative for the moveable attachment means 2*a* are shown. In this figure, which shows a part of the bottom of a body 10*b* of a button, a ring shaped member 2*b* is attached to a central section of a spring 15. The spring 15 extends between points on a distance from each other seen on the line 100 through edges 11*a* and 11*b*, which may be tapered edges 11*a* and 11*b* as shown in FIG. 18. The spring 15 is arranged in a groove, similar to the groove 16 as shown in FIG. 19, such that the spring 15 is countersunk in the body 10*b*, while the button can be connecting by threading through ring 2*b*. The spring again allows the movement of the attachment means, wherein the attachment means 2*b* are biased towards the initial, i.e. central location.

The present invention is not limited to the embodiment shown, but extends also to other embodiments falling within the scope of the appended claims.

The invention claimed is:

1. A mechanism for fastening fabrics, comprising:

a first fabric section, and a second fabric section;

the first fabric section comprising a button (1) having a body (10) and first attachment means (2) attached at a central location (5) of the body (10), attaching the button (1) to the first fabric section, wherein the body (10) of the button (1) has a tapering width (w), seen in a direction parallel to a plane of a lower surface (13) of the body (10), wherein the button (1) is further provided with second attachment means (3) at or near a circumferential edge (11) of the body (10) and wherein the tapering width (w) of the body (10) tapers towards the location (6) of the second attachment means (3) at or near the edge (11);

the second fabric section comprising a slit-shaped opening to receive the button (1) to fasten the first fabric section to the second fabric section;

wherein the button can be removed from the slit-shaped opening by pulling the two fabric sections apart.

2. The mechanism for fastening fabrics according to claim 1, wherein the button (1) is provided with the second attachment means (3) at a single location (6) at or near the circumferential edge (11).

3. The mechanism for fastening fabrics according to claim 1, wherein the body (10) of the button (1) has a tapering height (h), seen in a direction perpendicular to the plane of the lower surface (13) of the body (10), towards the location (6) of the second attachment means (3) at or near the edge (11).

4. The mechanism for fastening fabrics according to claim 1, wherein the body (10) tapers along at least half of the length (1) of the body (10), wherein the length (1) is measured along the line (100) extending through the second attachment means (3) at or near the edge (11) of the body (10) and the center-(5) of the body (10).

5. The mechanism for fastening fabrics according to claim 1, wherein the body (10) tapers substantially rectilinearly or planarly.

6. The mechanism for fastening fabrics according to claim 1, wherein the second attachment means (3) at or near the circumferential edge (11) comprise at least one through hole extending between the upper surface (12) and the lower surface (13) of the body (10) of the button (1).

7. The mechanism for fastening fabrics according to claim 6, wherein the body (10) is provided with a single through hole at or near the circumferential edge (11).

8. The mechanism for fastening fabrics (1) according to claim 7, wherein the circumferential edge (11) of the body (10) near the through hole comprises a recess (8) extending between the upper (12) and lower (13) surfaces.

9. The mechanism for fastening fabrics (1) according to claim 1, wherein the second attachment means (3) at or near the circumferential edge (11) comprise a passage having two ends (3*a*, 3*b*) extending through the body, wherein the ends (3*a*, 3*b*) are located at the lower surface (13) and/or the circumferential edge (11) of the body (10).

10. The mechanism for fastening fabrics (1) according to claim 1, wherein, seen in a cross sectional plane perpendicular to the line (100) extending through the second attachment means (3) at or near the edge (11) of the body (10) and the center-(5) of the body (10), the body has a tapering surface (12*a*, 13*a*) extending from one surface (12, 13) with decreasing height towards a lateral edge with the other surface (12, 13).

11. The mechanism for fastening fabrics (1) according to claim 10, wherein the body has a first tapering surface (13*a*) extending from a first surface (13) with decreasing height towards a lateral edge with the second surface (12) and a second tapering surface (12*a*) extending from the second surface (12) with decreasing height towards the opposed lateral edge with the first surface (13).

12. The mechanism for fastening fabrics (1) according to claim 10, wherein, seen in the cross sectional plane, the tapering surface (12*a*, 13*a*) makes an angle with the respect to the other surface (12, 13), wherein the angle increases from a first lower value near the edge (11) with the second attachment means (3) to a second larger value in a direction away from the edge (11) with the second attachment means (3).

13. The mechanism for fastening fabrics (1) according to claim 1, wherein the button (1) is further provided with third attachment means (3*e*) at or near the circumferential edge (11*b*) substantially opposite the second attachment means (3*d*) at the first edge (11*a*) of the body (10) and wherein the width (w) of the body (10) also tapers towards the location of the third attachment means (3*e*) at or near the edge (11*b*).

14. The mechanism for fastening fabrics (1) according to claim 10, wherein the body comprises four lateral edges sections (14*c,d*), wherein two first lateral edges sections (14*c*) extend towards the first attachment means (3*d*) at the first edge (11*a*) and wherein two second lateral edges sections (14*d*) extend towards the third-attachment means (3*e*) at the first edge (11*b*), wherein the body at least comprises tapering surfaces (13*a*, 12*a*) at a first lateral edge section (14*c*) and at a second lateral edge section (14*d*) opposite said first lateral edges section (14*c*).

15. The mechanism for fastening fabrics (1) according to claim 14, wherein the two tapering surfaces (12*a*, 13*a*) are mirror symmetrical with respect to a plane extending through said line (100) and perpendicular to the bottom surface (13).

16. The mechanism for fastening fabrics according to claim 6, wherein the circumferential edge near the through hole comprises a recess extending between the upper and lower surfaces.

* * * * *